US008512518B2

(12) United States Patent
Garcia Juez et al.

(10) Patent No.: US 8,512,518 B2
(45) Date of Patent: Aug. 20, 2013

(54) SECURITY PAPER, MANUFACTURING METHOD AND SECURITY DOCUMENT OBTAINED WITH SAID PAPER

(75) Inventors: Vicente Garcia Juez, Madrid (ES); Carlos Garcia Cuadrado, Madrid (ES)

(73) Assignee: Fabrica Nacional de Moneda y Timbre-Real Casa de la Moneda, Madrid (ES)

( * ) Notice: Subject to any disclaimer, the term of this patent is extended or adjusted under 35 U.S.C. 154(b) by 0 days.

(21) Appl. No.: 12/921,216

(22) PCT Filed: Mar. 6, 2009

(86) PCT No.: PCT/ES2009/000122

§ 371 (c)(1),
(2), (4) Date: Oct. 21, 2010

(87) PCT Pub. No.: WO2009/109682

PCT Pub. Date: Sep. 11, 2009

(65) Prior Publication Data

US 2011/0284177 A1 Nov. 24, 2011

(30) Foreign Application Priority Data

Mar. 7, 2008 (ES) ..... 200800676

(51) Int. Cl.
*B44F 1/12* (2006.01)

(52) U.S. Cl.
USPC ..... 162/140

(58) Field of Classification Search
USPC ..... 162/140, 103, 110, 114, 116; 283/83
See application file for complete search history.

(56) References Cited

U.S. PATENT DOCUMENTS

| | | | | |
|---|---|---|---|---|
| 4,462,866 | A | 7/1984 | Tooth et al. | |
| 4,943,093 | A * | 7/1990 | Melling et al. | 283/83 |
| 5,405,500 | A * | 4/1995 | Knight | 162/103 |
| 5,961,432 | A | 10/1999 | Murakami et al. | |
| 7,425,245 | B2 * | 9/2008 | Waters | 162/103 |
| 2008/0122218 | A1 * | 5/2008 | Reid et al. | 283/83 |

FOREIGN PATENT DOCUMENTS

| | | |
|---|---|---|
| CA | 2122528 | 11/1994 |
| CN | 1332819 | 1/2002 |
| EP | 0319157 | 6/1989 |
| EP | 0549384 | 6/1993 |
| ES | 2177746 | 12/2002 |
| ES | 2178067 | 12/2002 |
| GB | 2 260 772 | 4/1993 |
| GB | 2260772 | 4/1993 |
| GB | 2388377 | 11/2003 |
| JP | 2000256995 | 9/2000 |
| WO | 00/39391 | 7/2000 |
| WO | 00/56979 | 9/2000 |
| WO | 2004/050991 | 6/2004 |
| WO | 2006/099971 | 9/2006 |
| WO | 2009/081017 | 7/2009 |

OTHER PUBLICATIONS

International Search Report dated Jul. 3, 2009 from the corresponding PCT/ES2009/000122.
International Preliminary Report on Patentability dated Jun. 30, 2010, from the corresponding PCT/ES2009/000122.
Supplementary European Search Report dated Apr. 18, 2011, from corresponding European Application No. 09 71 7020.
Chinese First Office Action dated Oct. 25, 2011, from corresponding Chinese Application No. 200980115104.4.
Translation of Chinese Second Office Action dated Aug. 3, 2012, from corresponding Chinese Application No. 200980115104.4.

* cited by examiner

*Primary Examiner* — Mark Halpern
(74) *Attorney, Agent, or Firm* — Katten Muchin Rosenman LLP

(57) ABSTRACT

The invention consists in a security paper, as well as the security document obtained with it and the manufacturing process thereof, that combines the security elements called windowed thread with the high contrast single-tone watermark technique. In order to carry out this invention, we make use of the recesses created to cover the thread in the areas where it is visible, which exhibit a greater accumulation of fibers and are therefore opaque areas in the final paper, to insert therein the electrotype or high contrast single-tone watermarks.

16 Claims, 3 Drawing Sheets

SECURITY PAPER, MANUFACTURING METHOD AND SECURITY DOCUMENT OBTAINED WITH SAID PAPER

This application is a 371 of PCT/ES2009/000122 filed 6 Mar. 2009.

FIELD OF THE INVENTION

The object of the present invention relates to a security paper with which to manufacture security documents and/or banknotes.

Specifically, this invention uses the synergic effect of two security measures that are incorporated into this type of products in order to achieve an added security effect. These security measures include the incorporation into the security document of a security thread or strip and the incorporation of an electrotype watermark.

BACKGROUND OF THE INVENTION

One technique used to obtain a security paper for the printing of security documents and/or banknotes consists in inserting a security thread or strip during the paper manufacturing process. It is well known in the manufacture of security paper that the most common technique for shaping the sheet of paper is the so-called round technique, consisting in a metal drum that filters water that has cellulose fibres in suspension that thus remain on the surface of the drum whilst the water penetrates inside the drum. Similarly, it is also known that for the thread to remain perfectly integrated into the paper, it must be inserted during this stage of formation of the paper sheet, and consists in incorporating the thread around the drum onto which the cellulose fibres are being deposited, thus remaining embedded inside the fibres that are deposited on the surface of the drum.

As the water crosses the drum mesh, the fibres weave themselves together and the security thread or strip is enveloped by the mesh formed by said fibres as the sheet of paper is formed.

A second layer of paper created at the same time on another drum can be added to this first layer so that they remain intimately linked together, having been joined during their formation, and which together will make up the security paper.

A sheet of paper manufactured in this way, with the security thread or strip inside it, will then go through the subsequent stages of the manufacturing procedure in order to produce the security paper.

Although this is the most common way to manufacture banknote paper with embedded security threads, we shall also highlight other paper manufacturing processes based on flat top technology instead of the metal mould process.

There are patents dealing with security strips of relevant features, amongst which we find European Patent EP-0319157, relating to security threads incorporating drawings or legends performed on a metal layer where the partial demetallisation of such layer allows obtaining such security drawings or legends that would be visible to the naked eye.

British Patent GB-2,260,772 shows how to manufacture a document incorporating an element called windowed security threads where the thread embedded inside the security paper is exposed at spaced locations, thus being visible on the security document, which could be a banknote, as sequence of windows through which the security thread can be seen and remaining hidden in the rest of the document.

This facilitates locating such a security strip on the document and therefore facilitates the verification of the authenticity of the document as well as including the possibility of incorporating graphic designs on the thread that will highlight its presence in the document and improve its identification by a user.

This windowed thread effect is obtained using the metal mould paper manufacturing method by providing a series of raised portions on the drum surface on which the security thread rests.

When the security strip comes in contact with the raised portions of the formation drum, this space is not filled with fibres, such that the security paper or security document will have windows through which the security thread or strip will remain visible. This product is usually called windowed thread, since the security thread or strip is shown through the windows performed on the security paper.

Another security measure that can be incorporated to security documents are the so-called watermarks, which effect is achieved by more or less opacity in the document in different areas according to more or less fibres having been deposited during paper manufacture.

This depositing of more or less fibres is achieved by means of raised portions and recesses forming images or fanciful drawings on the mould used to manufacture the paper. The raised portions will produce a thinner layer of fibres on the paper manufactured, thus giving rise to lighter or less opaque areas, and the recesses on the drum will produce a greater accumulation of fivers leading to the formation of opaque areas that will not allow the passage of light. This combination of light and dark areas on the paper is what is called a watermark.

One type of watermark that is also known is described in European Patent EP-0549384, which is the technique known as the high contrast single-tone watermark. This technique allows inserting several elements, called electrotypes, in the paper manufacturing mould. These electrotypes prevent drainage in the areas of the paper they are placed in, that is, they prevent drainage of the water accompanying the fibres when they are deposited on the surface of the paper manufacturing mould. By preventing drainage, in the areas where these elements are inserted there is less deposition of fibres and therefore areas with less opacity.

These less opaque areas can be made more or less obvious depending on the relative height of said insertions.

Each one of these techniques, the windowed thread and the high contrast or electrotype watermark, have been used separately within a security paper or security document in order to offer a certain degree of safety to the document that includes them.

SUMMARY OF THE INVENTION

It is the object of the present invention to achieve a security paper that is suited to provide a security document, especially a document for the printing of banknotes that incorporates more effective security measures, more effective since they are more easily recognised by the public and also more difficult to copy by forgers.

It is also object of the invention that such security measures do not notably affect the final cost of the security document to be obtained.

This invention focuses its features on the adequate and non-obvious combination of the security elements described above, the windowed thread and the high contrast watermark technique. In order to carry out this invention, we make use of the recesses created to cover the thread in the areas where it is visible, which exhibit a greater accumulation of fibres and are therefore opaque areas in the final paper, to insert therein the electrotype or high contrast single-tone watermarks.

The invention brilliantly solves this problem that is technically highly complex by the joint application, artificially, of the areas of maximum and minimum paper opacity, which increases the visual impact of both, and located accurately within the document.

The final result will be a security paper with a windowed thread or strip that will be visible at spaced locations and having high contrast patterns in the areas where the security thread or strip is hidden, which patterns will be more pronounced since they are performed on the most opaque area of the document.

Since these security measures are included on the same area of the paper, as the high contrast single-tone watermarks are located beside the security thread or strip exactly in the hidden areas of these threads or strips, the same space of the security document can be used to include other alternative security measures instead of occupying a large surface of the document with these measures.

An unused area of the document, such as the area covering the security thread or strip, is therefore transformed into a security area that is easily recognized by the public based on a high contrast single-tone watermark. Since these techniques are commonly known when used separately, in a security document they shall be pleasantly perceived by the public using such security documents as elements of high security. Moreover, the difficulty of superimposing both security measures in a document leads to greater difficulty in the forging of such documents.

The security paper obtained with this technique has no limitations regarding the fibres, which may be of multiple types such as natural fibres, synthetic fibres or a combination of both.

Similarly, the security thread or strip can be of any of the types commonly known in this industry, comprising a flexible and waterproof substrate such as polyester, cellophane, etc. or a flexible and permeable substrate formed from fibres that can be natural fibres, synthetic fibres or a combination of both, such that this security thread or strip can be of a similar or different nature to that of the fibres used to manufacture the security paper itself.

The security thread or strip may incorporate a legend or ornamental motif that can be visible to the naked eye or using simple means of optical magnification, such legend or motif being achieved by the continuous or discontinuous metallisation of its surface and the demetallisation of such security thread or strip, or from printing on its surface.

The security thread or strip may incorporate dyes or fluorescent, phosphorescent, iridescent, magnetic materials, etc. in order to increase document security and prevent forgery.

The object of the invention, as mentioned above, is not only the security paper manufactured in this way, but also the security document and/or the banknote that can be obtained using this security paper.

Finally, the object of the invention is also the process for manufacturing this security paper and the relevant security document, a procedure comprising:

- inserting a security thread or strip using the windowed thread technique
- inserting electrotype watermarks in the recesses of the watermarks created to cover the windowed thread
- depositing the fibres forming the base of the paper on the mould surface
- extracting water through the mould in order to manufacture the sheet of paper
- drying the sheet of paper formed in this manner, with the electrotype watermark and the security thread or strip inside, in the subsequent processes of paper manufacture

BRIEF DESCRIPTION OF THE DRAWINGS

In order to complete the description that is being made and with the object of aiding towards a better understanding of the features of the invention, attached to the present specification and as an integral part thereof is a set of drawings in which the following has been represented with an illustrative and non-limiting nature.

DESCRIPTION OF A PREFERRED EMBODIMENT OF THE INVENTION

Figure 1:
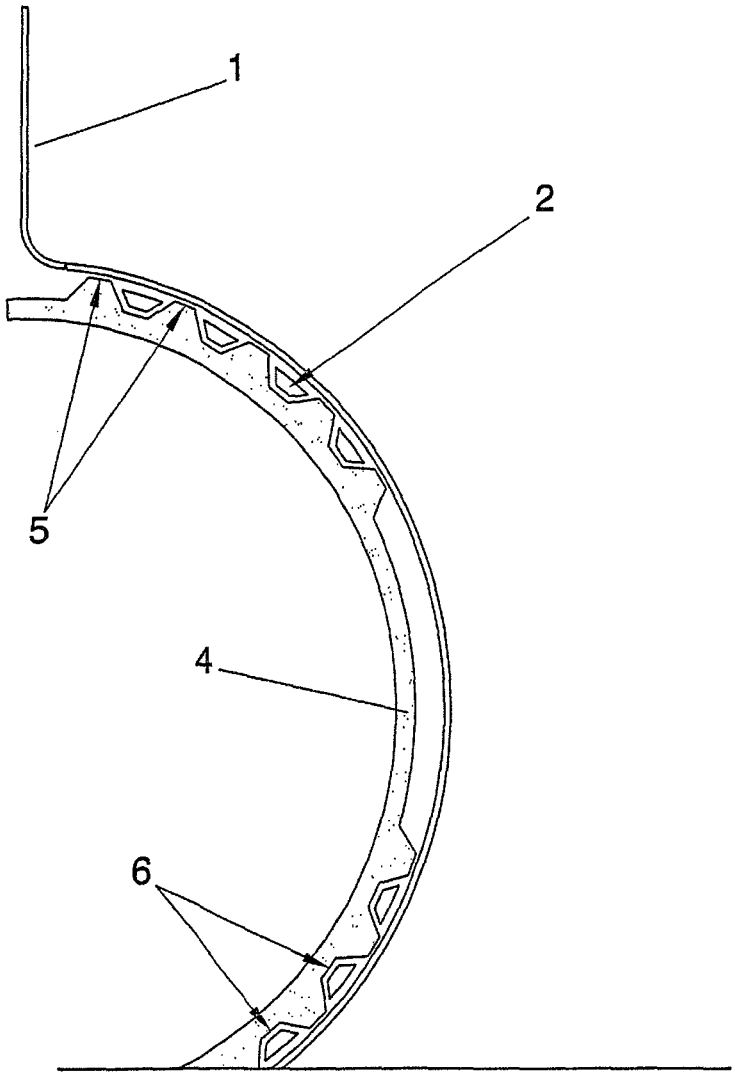
FIG. 1 shows the section of a mould superimposing the security measures of the invention.

FIG. 1 shows a section of a mould (4) where raised portions (5) and recesses (6) have been created, and how the electrotypes (2) are introduced between the raised portions (5) and are retained inside these spaces. This same figure shows the security thread or strip (1) that will rest on the raised portions (5) forming the windows through which the security thread or strip will be visible when the paper is formed, since they shall remain exposed.

Figure 2:
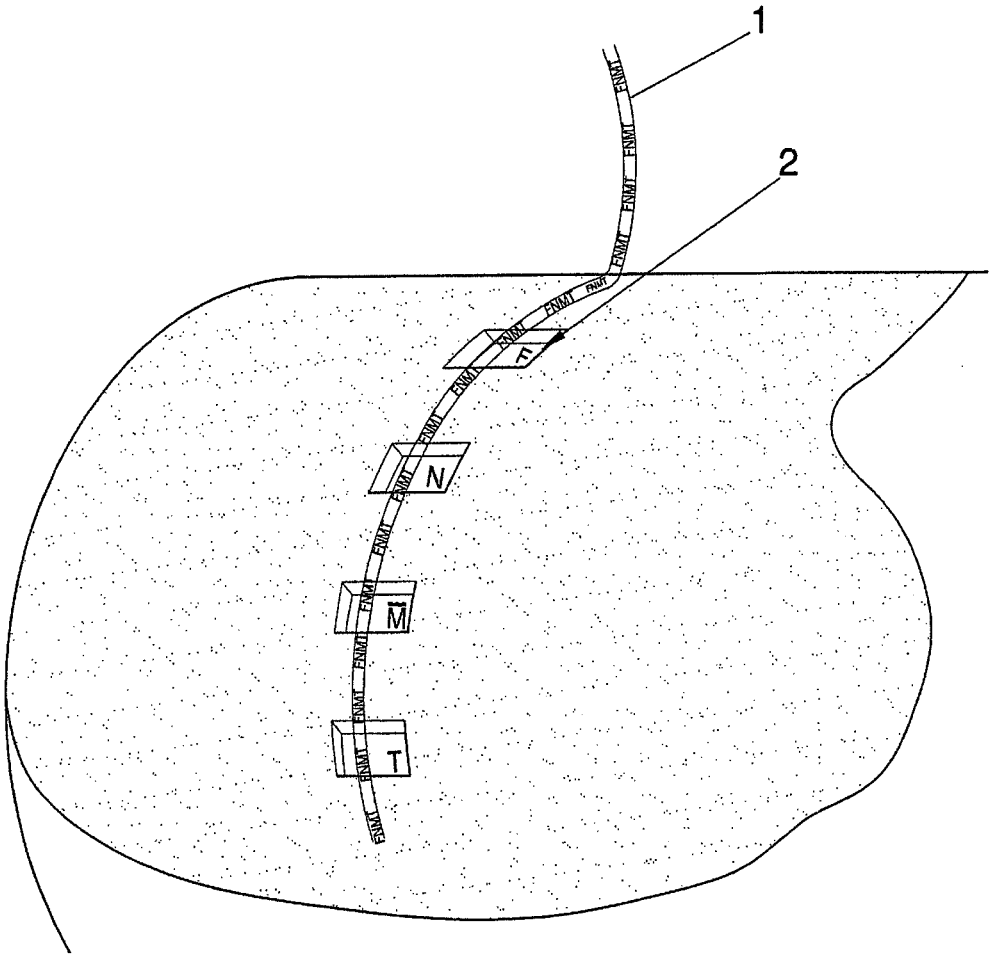
FIG. 2 shows a perspective view of a figure similar to FIG. 1.

FIG. 2 shows a perspective view of the elements shown in FIG. 1. This figure shows how the electrotypes are introduced between the raised portions (5) and how the security strip or thread (1) lies adjacent to the electrotypes placed.

Figure 3:
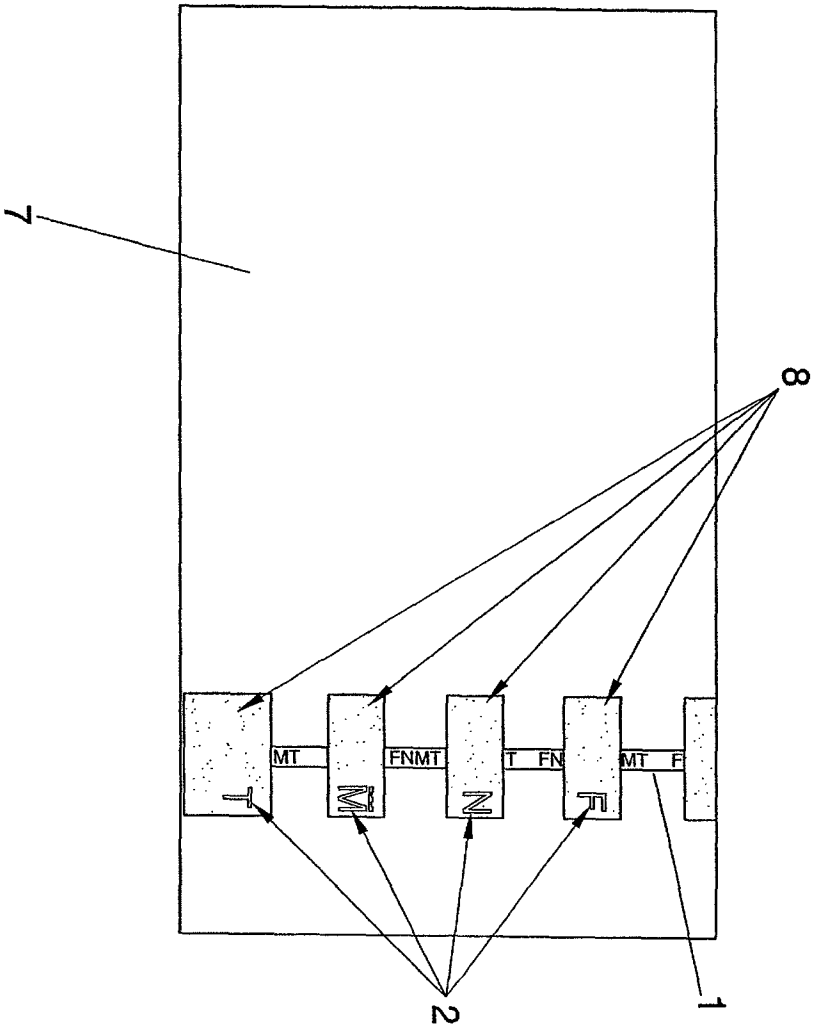
FIG. 3 shows a finished document with the two security elements visible in the document.

Finally, FIG. 3 shows how the security document (7) incorporates the windowed thread or strip that is visible in certain areas and hidden in other intermediate areas, hence the name "windowed", and how in the areas where the thread is hidden there are dark areas (8) where electrotype watermarks (2) are placed adjacent to the security thread or strip (1).

The invention claimed is:

1. A security paper for a document, the security paper comprising:

- a base comprising a first plurality of fibers; the base comprising a windowed area and a non-windowed area;
- a security thread or strip embedded in the base, the security thread or strip being visible in the windowed area, the security thread or strip being covered in the non-windowed area with a second plurality of fibers, the second plurality of fibers in the non-windowed area forming a bridge over the security thread or strip; and
- an electrotype watermark disposed in the non-windowed area and being adjacent to the security thread or strip without interference between the electrotype watermark and the security thread or strip and without overlapping the security thread or strip;
- wherein the first plurality of fibers and the second plurality of fibers comprise identical fibers, the second plurality of fibers having more fibers than the first plurality of fibers;
- wherein the bridge has more opacity than the base and the windowed area has less opacity than the base.

2. The security paper of claim 1, wherein the security thread or strip and the electrotype watermark are visible to the naked eye.

3. The security paper of claim 1, wherein the first plurality of fibers comprises natural fibers, synthetic fibers, or a combination of natural fibers and synthetic fibers.

4. The security paper of claim 1, wherein the security thread or strip comprise a flexible and waterproof substrate.

5. The security paper of claim 1, wherein the security thread or strip comprises a flexible and permeable substrate formed by a third plurality of fibers.

6. The security paper of claim 1, wherein the security thread or strip comprises a legend or an ornamental motif that is visible to the naked eye.

7. The security paper of claim 6, wherein the legend or the ornamental motif is formed on the security thread or strip by a continuous or discontinuous metallization and demetallization of the security thread or strip.

8. The security paper of claim 6, wherein the legend or the ornamental motif is printed on the security thread or strip.

9. The security paper of claim 1, wherein the security thread or strip comprises fluorescent pigments or materials.

10. The security paper of claim 1, wherein the security thread or strip comprises phosphorescent pigments or materials.

11. The security paper of claim 1, wherein the security thread or strip comprises magnetic pigments or materials.

12. The security paper of claim 1, wherein the security thread or strip comprises iridescent pigments or materials.

13. The security paper of claim 1, wherein the security thread or strip comprises optically variable pigments or materials.

14. The security paper of claim 1, wherein the electrotype watermark comprises a legend or an ornamental motif that is visible to the naked eye or with simple means of optical magnification.

15. A security paper for a document, the security paper comprising:

a base comprising a first plurality of fibers, the base having a first area having a first opacity and a windowed area having a second opacity, the second opacity being less than the first opacity;

a security thread or strip embedded in the base and passing through the first area and the windowed area;

an electrotype watermark disposed in the first area without interference between the electrotype watermark and the security thread or strip and without overlapping the security thread or strip, the electrotype watermark having a third opacity; and a bridge comprising a second plurality of fibers covering the security thread or strip, the bridge having a fourth opacity, the fourth opacity being greater than the first opacity so that the security thread or strip is not visible, wherein the third opacity is less than the fourth opacity;

wherein the first plurality of fibers and the second plurality of fibers comprise identical fibers, the second plurality of fibers having more fibers than the first plurality of fibers wherein the second opacity is less than the fourth opacity.

16. A security paper for a document, the security paper comprising:

a base comprising a first plurality of fibers, the base comprising a depressed area and a non-depressed area;

a security thread or strip embedded in the base and passing through the non-depressed area and the depressed area, the security thread or strip being visible in the depressed area, the security thread or strip being covered in the non-depressed area with the second plurality of fibers, the second plurality of fibers in the non-depressed area forming a bridge over the security thread or strip; and an electrotype watermark disposed in the non-depressed area and being adjacent to the security thread or strip without interference between the electrotype watermark and the security thread or strip and without overlapping the security thread or strip;

wherein the first plurality of fibers and the second plurality of fibers comprise identical fibers, the second plurality of fibers having more fibers than the first plurality of fibers;

wherein the bridge has more opacity than the base and the depressed area has less opacity than the base.

* * * * *